US008659583B2

(12) United States Patent
Cho

(10) Patent No.: US 8,659,583 B2
(45) Date of Patent: Feb. 25, 2014

(54) DISPLAY APPARATUS

(75) Inventor: Yeon-Je Cho, Yongin (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 157 days.

(21) Appl. No.: 13/005,144

(22) Filed: Jan. 12, 2011

(65) Prior Publication Data

US 2011/0193830 A1 Aug. 11, 2011

(30) Foreign Application Priority Data

Feb. 5, 2010 (KR) ..... 10-2010-0011176

(51) Int. Cl.
*G09G 5/00* (2006.01)

(52) U.S. Cl.
USPC ..... 345/204; 345/87; 345/100; 349/151

(58) Field of Classification Search
USPC ..... 345/76–100, 204–206; 349/40, 349/151–152
See application file for complete search history.

(56) References Cited

U.S. PATENT DOCUMENTS

| | | | | |
|---|---|---|---|---|
| 5,151,689 | A | 9/1992 | Kabuto et al. | |
| 7,023,419 | B2 | 4/2006 | Park | |
| 7,119,341 | B2 * | 10/2006 | Petrick | 250/370.09 |
| 7,623,202 | B2 * | 11/2009 | Araki et al. | 349/106 |
| 2001/0048106 | A1 | 12/2001 | Tanada | |
| 2002/0075204 | A1 | 6/2002 | Nakano et al. | |
| 2004/0233184 | A1 | 11/2004 | Toriumi et al. | |
| 2005/0104647 | A1 | 5/2005 | Choi et al. | |
| 2005/0156920 | A1 | 7/2005 | Tanaka | |
| 2005/0194657 | A1 | 9/2005 | Koide | |
| 2005/0231494 | A1 | 10/2005 | Kumada et al. | |
| 2006/0202937 | A1 | 9/2006 | Chen et al. | |
| 2006/0221001 | A1 * | 10/2006 | Matono et al. | 345/75.2 |
| 2006/0262068 | A1 * | 11/2006 | Nohtomi | 345/98 |
| 2008/0074567 | A1 * | 3/2008 | Jeon et al. | 349/33 |
| 2009/0073154 | A1 * | 3/2009 | Lee et al. | 345/211 |
| 2010/0013864 | A1 | 1/2010 | Oelhafen et al. | |
| 2010/0045638 | A1 * | 2/2010 | Cho et al. | 345/204 |

FOREIGN PATENT DOCUMENTS

| | | | |
|---|---|---|---|
| JP | 2-42420 | A | 2/1990 |
| JP | 11-194713 | A | 7/1999 |
| JP | 2001-166753 | A | 6/2001 |
| JP | 2002-108311 | A | 4/2002 |
| JP | 2004-272100 | A | 9/2004 |
| JP | 2005-181830 | A | 7/2005 |
| JP | 2006-259721 | A | 9/2006 |

(Continued)

OTHER PUBLICATIONS

Korean Office Action dated May 3, 2011 for Korean Patent Application No. KR 10-2010-0011176 which corresponds to captioned U.S. Appl. No. 13/005,144.

(Continued)

*Primary Examiner* — Jennifer Nguyen
(74) *Attorney, Agent, or Firm* — Knobbe Martens Olson & Bear LLP

(57) ABSTRACT

A display apparatus in which data lines of first and second sides of the display panel are connected is disclosed. In some embodiments, the display apparatus includes gate driving units respectively driving the first and second sides of the panel. The surface area of a data driving block which occupies a large portion of a driver circuit is, accordingly, reduced.

18 Claims, 4 Drawing Sheets

(56) References Cited

FOREIGN PATENT DOCUMENTS

| | | | |
|---|---|---|---|
| JP | 2007-233202 | A | 9/2007 |
| JP | 2009-519492 | A | 5/2009 |
| KR | 2001-0105273 | A | 11/2001 |
| KR | 2002-0058716 | A | 7/2002 |
| KR | 10-2005-0046173 | A | 5/2005 |
| KR | 10-2006-0045763 | A | 5/2006 |
| KR | 10-2008-0006363 | A | 1/2008 |
| KR | 10-2009-0116941 | A | 11/2009 |

OTHER PUBLICATIONS

Japanese Office Action dated Sep. 11, 2012 for Japanese Patent Application No. JP 2010-238561 which shares priority of Korean Patent Application No. KR 10-2010-0011176 with captioned U.S. Appl. No. 13/005,144.

Japanese Office Action dated Apr. 23, 2013 for Japanese Patent Application No. JP 2010-238561 which shares priority of Korean Patent Application No. KR 10-2010-0011176 with captioned U.S. Appl. No. 13/005,144.

* cited by examiner

DISPLAY APPARATUS

CROSS-REFERENCE TO RELATED APPLICATIONS

This application claims the benefit of Korean Patent Application No. 10-2010-0011176, filed on Feb. 5, 2010, in the Korean Intellectual Property Office, the disclosure of which is incorporated herein in its entirety by reference.

BACKGROUND

1. Field

The disclosed technology relates to a display apparatus, and more particularly, to a display apparatus used for amorphous silicon gate (ASG) panels and low temperature poly silicon (LTPS) panels which include a gate driving circuit.

2. Description of the Related Technology

Compact thin film transistor liquid crystal displays (TFT-LCDs) used in portable display apparatuses such as mobile communication terminals include a source driver for driving a source line, a gate driver for driving a gate line, and a power integrated circuit that supplies power voltages to a panel and various drivers and has a charge pump.

According to amorphous silicon gate (ASG) technology, a gate integrated circuit (IC) is included on a glass substrate and a timing control function provided by a driver IC to reduce a circuit surface area and the number of components. An ASG panel or a low temperature polysilicon (LTPS) panel may include a gate shift register block in the panel. Accordingly, the driver IC uses one signal for controlling a gate shift register, and thus a surface area of a gate block in a driver IC may be greatly reduced.

SUMMARY OF CERTAIN INVENTIVE ASPECTS

One inventive aspect is a display apparatus including a display panel in which data lines of a first side of the panel and data lines of a second side of the panel are connected to one another. The display apparatus also includes a first gate driving unit for providing a gate signal to the first side of the panel, a second gate driving unit for providing a gate signal to the second side of the panel, and a driver circuit configured to control the first gate driving unit and the second gate driving unit, and to provide a data signal to the first side of the panel and to the second side of the panel.

Another inventive aspect is a display apparatus including a display panel. The display panel includes n gate lines, m data lines crossing the n gate lines, and a plurality of pixel units disposed near crossing points of the gate lines and the data lines. A first side of the panel has first through m/2-th data lines and a second side of the panel has (m/2+1)-th through m-th data lines, and the first through m/2-th data lines and m-th through (m+2)/2 data lines are respectively sequentially connected. The display apparatus also includes a first gate driving unit configured to provide a gate signal to the first side of the panel with a portion of the n gate lines, a second gate driving unit for providing a gate signal to the second side of the panel with another portion of the n gate lines, and a driver circuit configured to control the first and second gate driving units and to provide a data signal to the first and second sides of the panel with the first through m/2-th data lines.

Another inventive aspect is a display apparatus, including a display panel in which data lines of a first side of the panel and data lines of a second side of the panel are connected to one another, and a driver circuit configured to provide a data signal to the first side of the panel and to the second side of the panel with the data lines of one of the first and second sides of the panel.

BRIEF DESCRIPTION OF THE DRAWINGS

The above and other features and advantages are described with exemplary embodiments thereof with reference to the attached drawings in which.

DETAILED DESCRIPTION OF CERTAIN INVENTIVE EMBODIMENTS

Various features are described more fully with reference to the accompanying drawings, in which exemplary embodiments of the invention are discussed. In general, elements that are necessary to understand the structure and operation of the embodiments are described, and certain detailed explanations of other elements may be omitted.

The meaning of the terms used in the present specification and claims of the present invention should not necessarily be limited to be of ordinary or literary meaning but construed as not departing from the spirit and scope of the inventive aspects of the described embodiments.

Figure 1A:
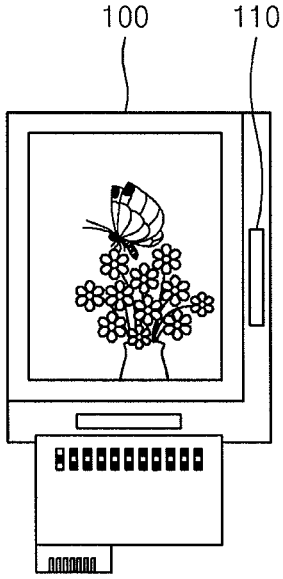
FIGS. 1A and 1B are comparison views illustrating two amorphous silicon gate (ASG) panels.
Figure 1B:
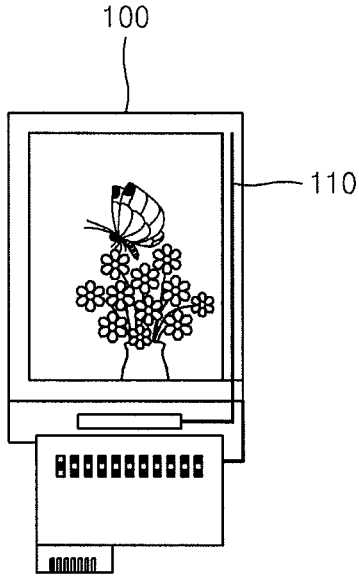

FIGS. 1A and 1B show two an amorphous silicon gate (ASG) panels.

FIG. 1A illustrates an ASG panel having a two-chip structure and FIG. 1B illustrates an ASG panel having a one-chip structure. According to ASG technology, a gate circuit using a-Si thin-film transistor (TFT) is integrated on a glass substrate and is used as a gate driver in a panel. As shown in FIG. 1B, the gate driver, which may be disposed outside the panel according to FIG. 1A, is removed so that a one-chip module is realized. According to the ASG technology, an ASG is integrated under a black matrix (BM) of a color filter to obtain a symmetrical narrow bezel and thus a slim display module. However, even according to the ASG technology, a driver IC may be disposed outside the panel, and thus a data driving block which mostly occupies a driver IC still requires the same surface area.

Also, according to low temperature polysilicon (LTPS) technology, not only a gate driver but also a de-multiplexing unit included in a driver IC may be integrated in a panel. Accordingly, the LTPS technology may have better integration than the ASG technology. However, even according to the LTPS technology, other components, such as a driver IC, a source driver, a SRAM, a timing control unit, a DC/DC converter, or the like require surface area. Thus, the size of a source block that mostly occupies the driver IC needs to be reduced to reduce the size of the driver IC.

Figure 2:
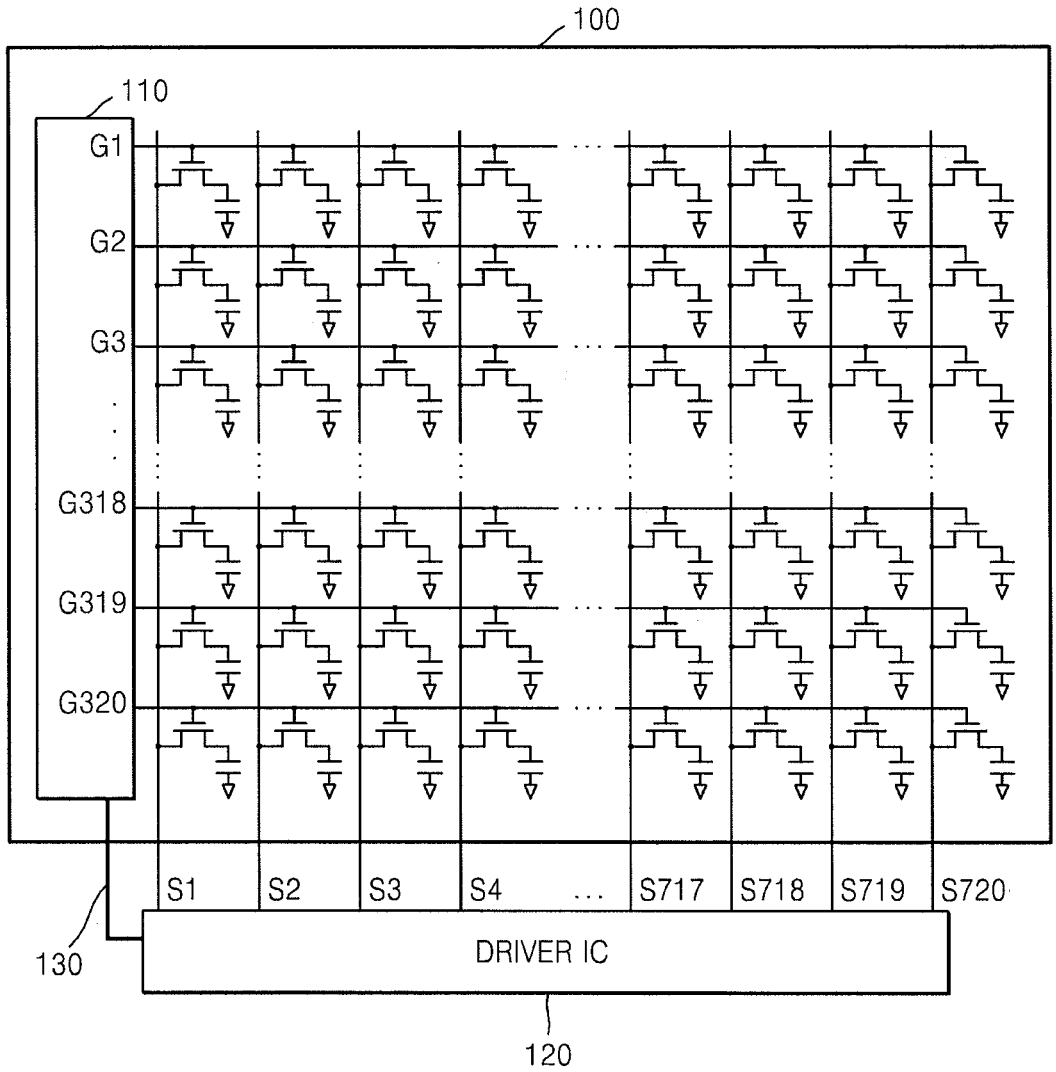
FIG. 2 is a schematic diagram illustrating connections between a gate driving unit and a driver integrated circuit (IC) in a panel.

FIG. 2 illustrates connections between a gate driving unit 110 and a driver IC 120 of a display panel 100.

Referring to FIG. 2, the display apparatus 100 includes the gate driving unit 110 and pixel units disposed in portions where gate lines G1, . . . , G320 that extend from the gate driving unit 110 and data lines S1, . . . , S720 that extend from the driver IC 120. The display panel 100 may be, for example, a liquid crystal display (LCD) panel or an organic light emitting diode (OLED) panel. Accordingly, a pixel unit may comprise a LCD and a driving circuit or an OLED and a driving circuit. The display panel 100 illustrated in FIG. 2 has a 320×240 resolution for realizing a Quarter Video Graphics Array (QVGA). Accordingly, 320 gate lines, and 720, that is, 240×RGB, data lines are illustrated.

The driver IC 120 outputs a gate control signal 130 for controlling the gate driving unit 110 and data signals via the 720 data lines S1, . . . , S720 in the display panel 100.

In a display apparatus as illustrated in FIG. 2, the gate driving unit 110 is disposed in the display panel 100, and thus only the gate control signal 130 needs to be output in order to control a shift register of the gate driving unit 110 by using the driver IC 120 but data signals still need to be output via the 720 data lines.

Figure 3:
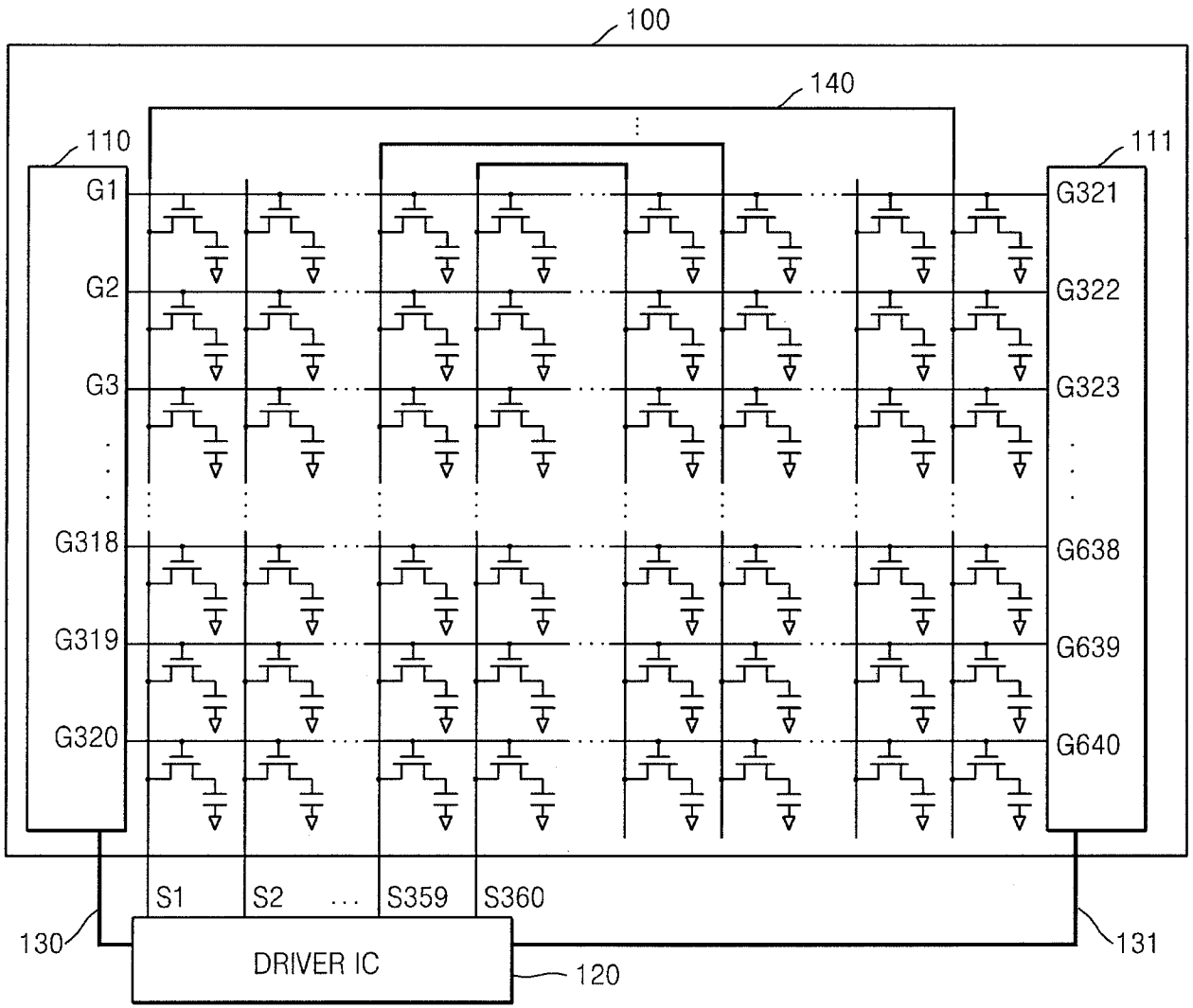
FIG. 3 is a schematic diagram illustrating connections between first and second gate driving units and a driver IC in a display panel, according to an embodiment.

FIG. 3 illustrates connections between first and second gate driving units 110 and 111 and a driver IC 120 in a display panel 100, according to an embodiment of the present invention.

Referring to FIG. 3, the display panel 100 includes first gate driving unit 110 and second gate driving unit 111. The first gate driving unit 110 provides gate signals G1, . . . , G320 to pixel units in a left display area of the display panel 100, and the second gate driving unit 111 provides gate signals G321, . . . , G640 to pixel units in a right display area of the display panel 100. Also, data signals of the pixel units of a left side of the display panel 100 are connected with data lines of the pixel units of a right side of the panel via connection lines 140. For example, a first data line S1 of the left side of the panel is connected to a $720^{th}$ data line S720 of the right side of the panel, and a second data line S2 of the left side of the panel is connected to a $719^{th}$ data line S719 of the right side of the panel. In this manner, data lines of the left side of the panel and data lines of the right side of the panel are symmetrically connected.

The driver IC 120 is placed outside the display panel 100 and controls the first gate driving unit 110 and the second gate driving unit 111, and provides data signals S1, . . . , S360 to the left side of the panel and through the left side of the panel to the data lines on the right side of the panel. As can be seen in FIG. 3, the number of data lines in the driver IC 120 providing data signals is reduced by half, compared to the data lines illustrated in FIG. 2. That is, a gate is driven differently with respect to left and right portions of the display panel 100, which increases the number of driven gates in the display panel 100 but the number of data channels of the driver IC 120 outside the display panel 100 is reduced by half. Also, only a gate control signal needs to be provided to the shift register of the first gate driving unit 110 and the second gate driving unit 111. Accordingly, surface area of a data block or a source block which is mostly occupied by the driver IC 120 may be reduced by half.

Figure 4:
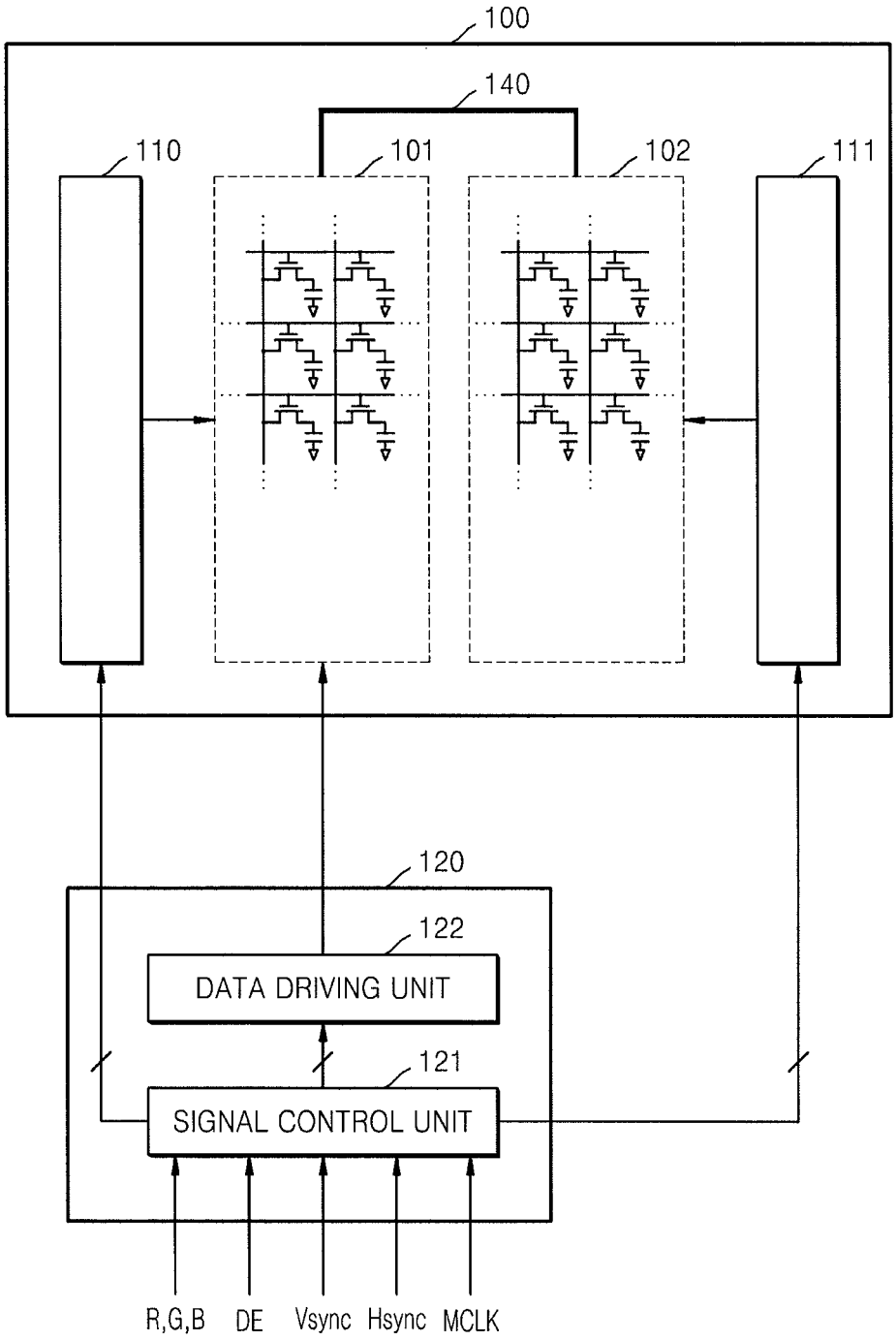
FIG. 4 is a schematic diagram illustrating connections between a gate driving unit and a driver IC in a display panel, according to another embodiment.

FIG. 4 illustrates connections between driver IC 120 and display panel 100, according to another embodiment.

Referring to FIG. 4, the driver IC 120 includes a signal control unit 121 and a data driving unit 122. Other components of the driver IC 120, such as a static random access memory (SRAM) or a power supply unit are not displayed.

The signal control unit 121 receives an input image signal and an input control signal from a graphic controller (not shown). For example, the signal control unit 121 receives an input image signal including image data R, G, and B and an input control signal including a vertical synchronization signal Vsync, a horizontal synchronization signal Hsync, a main clock MCLK, and a data enable signal DE. Also, the signal control unit 121 conducts signal processing on image signals according to various operations of the display panel 100 to generate internal image data R, G, and B, and generates a gate control signal and a data control signal. The signal control unit 121 transmits the internal image data R, G, and B and the data control signal to the data driving unit 122, and transmits a gate control signal to the first gate driving unit 110 and the second gate driving unit 111. The internal image data R, G, and B are realigned according to the pixel arrangement of the display panel 100, and may be corrected by using a pixel correction circuit. Also, the data control signal includes a horizontal synchronization start signal STH that indicates a transmission start of image data, a load signal LOAD that causes the data driving unit 122 to apply a data signal to a corresponding data line, etc. The gate control signal may include a vertical synchronization start signal STV that causes the first and second gate driving units 110 and 111 to start outputting gate on voltages Von, a gate clock signal CKV, an output enable signal OE, and/or the like.

The data driving unit 122 converts image data in a digital form into an analog form by using a gray scale voltage generated from a gray scale voltage generating unit (not shown), and applies the gray scale voltage as a data signal to each of the data lines of a left side of the panel 101. Alternatively, the gray scale voltage may be applied to a right side of the panel 102. That is, as the data driving unit 122 applies data signals via the data lines of one of the left and right sides of the panel 101 and 102 to both the left and right sides of the panel 101 and 102. Accordingly, surface area of the data driving unit 122 in the driver IC 120 may be reduced by half. Referring to FIG. 4, the data driving unit 122 applies data signals only to the data lines S1, . . . , S360 of the left side of the panel 101, which are also connected to the data lines of the right side of the panel 102.

According to the display apparatus, data lines of left and right sides of the panel are connected, and the display apparatus includes gate driving units respectively driving the left and right sides of the panel. Data signals are provided to the data lines of both of the left and right sides of the panel through only one of the left and right sides of the panel, thereby reducing the needed surface area for a data driving circuit. Because the data driving circuit generally occupies a large portion of a driver integrated circuit (IC), the connections significantly reduce area and possibly the number of chips in the driver IC accordingly.

For the purposes of promoting an understanding of various inventive aspects and principles, reference has been made to the embodiments illustrated in the drawings, and specific language has been used to describe these embodiments. However, no limitation of the scope of the invention is intended by this specific language.

The various embodiments may be described in terms of functional block components and various processing steps. Such functional blocks may be realized by any number of hardware and/or software components configured to perform the specified functions. For example, the embodiments may employ various integrated circuit components, e.g., memory elements, processing elements, logic elements, look-up tables, and the like, which may carry out a variety of functions under the control of one or more microprocessors or other control devices. Similarly, where the elements of the embodiments are implemented using software programming or software elements the embodiments may be implemented with any programming or scripting language such as C, C++, Java, assembler, or the like, with the various algorithms being implemented with any combination of data structures, objects, processes, routines, or other programming elements.

Functional aspects may be implemented in algorithms that execute on one or more processors. Furthermore, the embodiments could employ any number of techniques for electronics configuration, signal processing and/or control, data processing and the like. The words "mechanism" and "element" are used broadly and are not limited to mechanical or physical embodiments, but can include software routines in conjunction with processors, etc.

The particular implementations shown and described herein are illustrative examples of various inventive aspects and are not intended to otherwise limit the scope in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be used. Moreover, no item or component is essential to the practice of the invention unless the element is specifically described as "essential" or "critical".

The use of the terms "a" and "an" and "the" and similar referents in the context of describing the invention (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Finally, the operations of all methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope. Numerous modifications and adaptations will be readily apparent to those skilled in this art without departing from the spirit and scope.

While various inventive aspects have been particularly shown and described with reference to exemplary embodiments, it will be understood by those of ordinary skill in the art that various changes in form and details may be made therein.

What is claimed is:

1. A display apparatus, comprising:

a display panel in which a plurality of data lines of a first side of the panel and a plurality of data lines of a second side of the panel are connected to one another with connections which are schematically symmetric about a line between the data lines of the first and second sides;

a first gate driving unit for providing a gate signal to the first side of the panel;

a second gate driving unit for providing a gate signal to the second side of the panel; and a driver circuit configured to control the first gate driving unit and the second gate driving unit, and to provide a data signal to the data lines of the first side of the panel and to the data lines of the second side of the panel;

wherein the driver circuit is further configured to generate a first gate control signal to the first gate driving unit and a second gate control signal to the second gate driving unit, and wherein each gate control signal comprises a vertical synchronization start signal that is applied to each gate driving unit at the same time.

2. The display apparatus of claim 1, wherein the driver circuit is an integrated circuit (IC).

3. The display apparatus of claim 1, wherein the driver circuit comprises:

a data driving unit configured to provide a data signal to the first side of the panel and to the second side of the panel; and a signal control unit configured to provide a first gate control signal to the first gate driving unit, a second gate control signal to the second gate driving unit, and a data control signal to the data driving unit.

4. The display apparatus of claim 1, wherein the first gate driving unit and the second gate driving unit are mounted to the display panel.

5. The display apparatus of claim 1, wherein the display panel is an amorphous silicon gate (ASG) panel.

6. The display apparatus of claim 1, wherein the display panel is a low temperature polysilicon (LTPS) panel.

7. The display apparatus of claim 1, wherein the display panel is a liquid crystal display (LCD) panel.

8. The display apparatus of claim 1, wherein the display panel is an organic light emitting diode (OLED) panel.

9. A display apparatus, comprising:

a display panel, comprising:

n gate lines, m data lines crossing the n gate lines;

a plurality of pixel units disposed near crossing points of the gate lines and the data lines, wherein a first side of the panel has first through m/2-th data lines and a second side of the panel has (m/2+1)-th through m-th data lines, and wherein the first through m/2-th data lines and m-th through (m+2)/2 data lines are respectively sequentially connected with connections which are schematically symmetric about a line between the data lines of the first and second sides of the panel;

a first gate driving unit configured to provide a gate signal to the first side of the panel with a portion of the n gate lines;

a second gate driving unit for providing a gate signal to the second side of the panel with another portion of the n gate lines; and a driver circuit configured to control the first and second gate driving units and to provide a data signal to the first and second sides of the panel with the first through m/2-th data lines;

wherein the driver circuit is further configured to generate a first gate control signal to the first gate driving unit and a second gate control signal to the second gate driving unit, and wherein each gate control signal comprises a vertical synchronization start signal that is applied to each gate driving unit at the same time.

10. The display apparatus of claim 9, wherein the driver circuit is an integrated circuit (IC).

11. The display apparatus of claim 9, wherein the driver circuit comprises:

a data driving unit configured to provide a data signal to the first and second sides of the panel via the first through m/2 data lines; and a signal control unit configured to provide a first gate control signal to the first gate driving unit, a second gate control signal to the second gate driving unit, and a data control signal to the data driving unit.

12. The display apparatus of claim 9, wherein the first gate driving unit and the second gate driving unit are mounted on the display panel.

13. The display apparatus of claim 9, wherein the display panel is an amorphous silicon gate (ASG) panel.

14. The display apparatus of claim 9, wherein the display panel is a low temperature polysilicon (LTPS) panel.

15. The display apparatus of claim 9, wherein the display panel is a liquid crystal display (LCD) panel.

16. The display apparatus of claim 9, wherein the display panel is an organic light emitting diode (OLED) panel.

17. A display apparatus, comprising:

a display panel having a plurality of pixels in which a plurality of data lines of a first side of the panel and a plurality of data lines of a second side of the panel are connected to one another with connections which are schematically symmetric about a line between the data lines of the first and second sides of the panel;

a driver circuit configured to provide a data signal to the data lines of the first side of the panel and to the data lines of the second side of the panel with the data lines of one of the first and second sides of the panel;

wherein first ones of the pixels on the first side of the display panel and second ones of the pixels on the second side of the display panel are connected to the data lines on their respective side of the display panel;

a first gate driver providing a gate signal to the pixels on the first side of the display panel;

a second gate driver providing a gate signal to the pixels on the second side of the display panel;

wherein the driver circuit is further configured to generate a first gate control signal to the first gate driver and a second gate control signal to the second gate driver, and wherein each gate control signal comprises a vertical synchronization start signal that is applied to each gate driver at the same time.

18. The display apparatus of claim 17, wherein the driver circuit comprises:

a data driving unit configured to provide the data signal according to a data control signal; and a signal control unit configured to provide the data control signal to the data driving unit.

* * * * *